United States Patent [19]

Ziebarth et al.

[11] 4,182,423

[45] Jan. 8, 1980

[54] WHIPSTOCK AND METHOD FOR DIRECTIONAL WELL DRILLING

[75] Inventors: Timothy D. Ziebarth; Ray L. Hauser; James R. Thompson; John F. Harris; Michael P. Gibbons, all of Boulder County, Colo.; Guy C. Burton, Natrona County, Wyo.

[73] Assignee: Burton/Hawks Inc., Casper, Wyo.

[21] Appl. No.: 882,581

[22] Filed: Mar. 2, 1978

[51] Int. Cl.[2] ..... E21B 7/06; E21B 7/08

[52] U.S. Cl. ..... 175/61; 166/117.5

[58] Field of Search ..... 166/117.5, 259; 175/61

[56] References Cited

U.S. PATENT DOCUMENTS

| | | | |
|---|---|---|---|
| 2,043,381 | 6/1936 | Lane | 166/117.5 |
| 2,058,327 | 10/1936 | Lane | 166/117.5 |
| 2,281,414 | 4/1942 | Clark | 166/117.5 |
| 2,297,029 | 9/1942 | Shepherd et al. | 166/117.5 |
| 2,331,293 | 10/1943 | Ballard | 166/117.5 |
| 2,404,341 | 7/1946 | Zublin | 175/61 X |
| 3,223,158 | 12/1965 | Baker | 166/259 |

*Primary Examiner*—Stephen J. Novosad
*Attorney, Agent, or Firm*—Sheridan, Ross, Fields & McIntosh

[57] ABSTRACT

A wedge-shaped whipstock is provided for directional well drilling which tapers from the lead end to a thick section at the bottom, and is fabricated from a tough polymeric material. An adhesive coating is applied to the outside surface of the wedge for permanent adherence of the whipstock to the surface of the drill hole. A deformable highly viscous material can fill and complement the internal wedge portion to produce a cylindrical configuration prior to use. Alternatively, or in conjunction with the deformable viscous material, a compressive element having a shaped compression face and made from a frangible material may be formed on the drill bit and/or attached to the prepared whipstock for the lowering of the tool into the drill hole and bonding the whipstock in place. The bottom surface of the whipstock is reinforced for positioning in the hole over a bridge plug or broken drill pipe. The weight of the drill bit and stem applied to the compressive element deforms the viscous filler material and laterally sets the whipstock in the hole. Rotation of the drill bit destroys the compressive element; and the drill, following the face of the wedge, drills an offset hole at an angle to the original. Various attachments, arrangements, and materials are provided for the whipstock wedge, filler portion and compressive element.

52 Claims, 18 Drawing Figures

WHIPSTOCK AND METHOD FOR DIRECTIONAL WELL DRILLING

BACKGROUND OF THE INVENTION

The present invention is directed to an apparatus and method for directional well drilling. It is more specifically directed to a resilient wedge-shaped whipstock which is permanently set in proper location in a drill hole.

In the past, various types of drill deflecting devices called "whipstocks" have been provided for insertion within a drill hole. These devices are commonly required when the lower portion of the hole has become blocked due to equipment debris, such as a broken drill stem, which can not be readily removed. In some cases this obstruction necessitates starting a completely new well. However, whenever possible, it is desirable from a cost standpoint, to utilize as much of the original hole as possible and offset a new lower hole portion to bypass the obstruction. The whipstock allows the drill bit and stem to be deflected past the blocked hole to provide this necessary offset.

Numerous prior art provisions have been made for lowering and using a whipstock in the original hole and setting it mechanically. In these, however, the reliance has been placed on various mechanical expanding mechanisms for wedging and holding the whipstock in position. These types of devices are inherently expensive and contribute considerably to the drilling costs.

Conventional whipstocks are made of metal, the idea being to provide a wedge face which cannot be affected or crushed by the bit. However, this usually results in excessive costs from rapid drill bit deterioration and long drill-off times. The whipstock described herein has a softer surface that is deformable, yet tough, durable and resilient, thus, resistant to the crushing action of the drill bit. Thus, the drill bit is essentially unaffected by contact with the present invention and drill-off rates can be accomplished within a few minutes.

It has been recognized for years that some type of reliable inexpensive whipstock would be highly desirable. In addition, it would be desirable to have a whipstock which could be easily positioned within the hole without need for cementing and conveniently set to meet the desired directional drilling requirements.

In other cases, it is desirable to orient the drill stem both in angle and direction in order to obtain penetration of oil bearing formations at an optimum position. Directional drilling is also common where high dip angles of bedding planes may force a drill string off a desired path.

In all four of the above cases, a significant improvement over current methods is provided by this new and improved whipstock. Specifically, current methods of deviation (when not drilling off the bottom) often require cementing the hole to a depth above the junk or to a position where deviation is required. Cementing has significant actual costs, and more importantly usually requires a 24–48 hour cure time which results in rig down-time and considerable expense. The whipstock described herein obviates the need for cementing and it does not require rig down-time.

It is sometimes desired to form a multiplicity of feeder or side-track holes at the bottom of an oil well in order to increase the gathering capacity of the well. Such a "crow's foot" arrangement requires multiple directional drilling and removal of the whipstock used for each. The whipstock of this invention can be removed when desired by using a cutting drill to remove the tough polymer. Whereas the tough, resilient wedge of this whipstock is remarkably durable and wear resistant to a crushing type of star bit, it is still easily cut and removed by a sharp drill designed for cutting through plastics.

In mining exploration using core or side-track holes, the multiple downhole branching technique as described above can save expensive surface drilling and rig relocation by providing for several core sites from one upper drill hole. Removal of the whipstock would not be mandatory in this instance.

It is therefore an object of the present invention to provide such a whipstock which can be both easily and inexpensively manufactured and which would substantially reduce the expense involved when it is necessary to provide offset directional drilling.

It is a further object of the present invention to provide a directional drilling arrangement in which the device can be easily lowered into the hole and securely fixed in proper position.

It is a still further object of the present invention to provide a whipstock manufactured from relatively lightweight, inexpensive material which will provide continued operation after many drill bit passages and remain securely attached to the drill hole in its required position.

A further object of the present invention is to provide a whipstock which can be set in position and properly secured by the actual drill bit and drill stem used in the drilling operation without the requirement for additional lowering and placing of the equipment.

It is a further object of the present invention to provide a whipstock and components which can be securely adhered to each other in a compact cylindrical unit, and which can provide the desired results with a minimum of down-time for placement, setting and offset drilling.

It is a further object of this invention to provide a whipstock device which can be permanently set and drilled off even without the requirement for cement.

It is a still further object of this invention to provide a whipstock device which can be easily and quickly cut-out when desired so that multiple feeder holes can be accomplished at the bottom of an oil or gas well.

SUMMARY OF THE INVENTION

An inexpensive and easily placed whipstock is provided having an elongated tapered wedge-shaped deflection portion sized to conveniently fit within the drill hole. A filler material can be provided in conjunction with the wedge to complement it and produce a cylindrical unit for well insertion. The lower end of the wedge portion is reinforced such as by a steel plate to allow the whipstock to be positioned over a bridge plug or broken equipment remaining within the hole.

A compression element is positioned or attached to the upper end of the whipstock for deforming the filler material and creating lateral compression forces against the whipstock for permanently setting it in the hole. The compression element can be formed or attached to the drill bit for lowering the entire unit and subsequently continuing the drilling operation. An adhesive layer is provided on the outside surface of the wedge portion for adhering the wedge-shaped whipstock deflector to the surface of the drill hole.

The mating face of the compression element in contact with the deformable filler material can be either flat, hemispherical, wedge-shaped, conical, or any combination of surfaces which will provide suitable compressive forces on the filler material to compress and deform the material downward across the face of the wedge to properly set the whipstock against the surface of the hole. By this method, the whipstock is secured in position to prevent loosening or rotation during use.

It can be easily seen that the use of the present invention is highly desirable from the standpoint that the actual drill bit and drill stem used in the drilling operation can be used to position and set the whipstock without necessity for removing the drill stem before the drilling operation can continue. Or the tool can be lowered on the drill stem with only one trip to the surface required to attach the bit. Thus, a considerable savings in time and money can be effected by the use of the whipstock according to the present invention. In addition, cementing costs normally associated with conventional whipstocking and directional drilling can be eliminated.

BRIEF DESCRIPTION OF THE DRAWINGS

Other features of this invention will appear in the following description and appended claims, reference being made to the accompanying drawings forming a part of the specification where like reference characters designate corresponding parts in the several views.

DETAILED DESCRIPTION OF THE EMBODIMENTS

Figure 1:
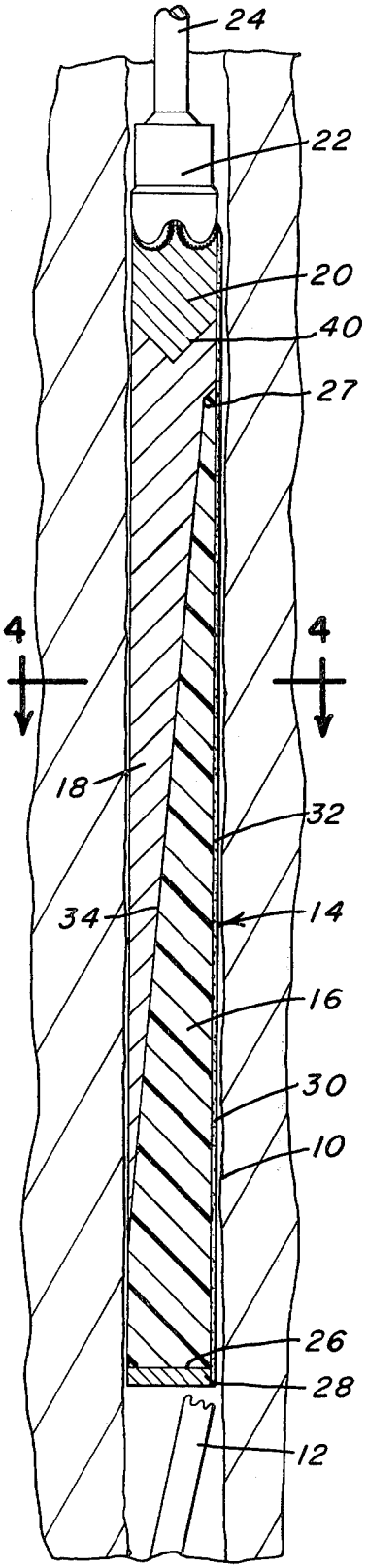
FIG. 1 is a side sectional view of the improved whipstock tool for directional well drilling showing the sections of the deflecting tool positioned above debris remaining within the hole, the tool is shown attached to the bit at the end of the drill stem.
Figure 3:
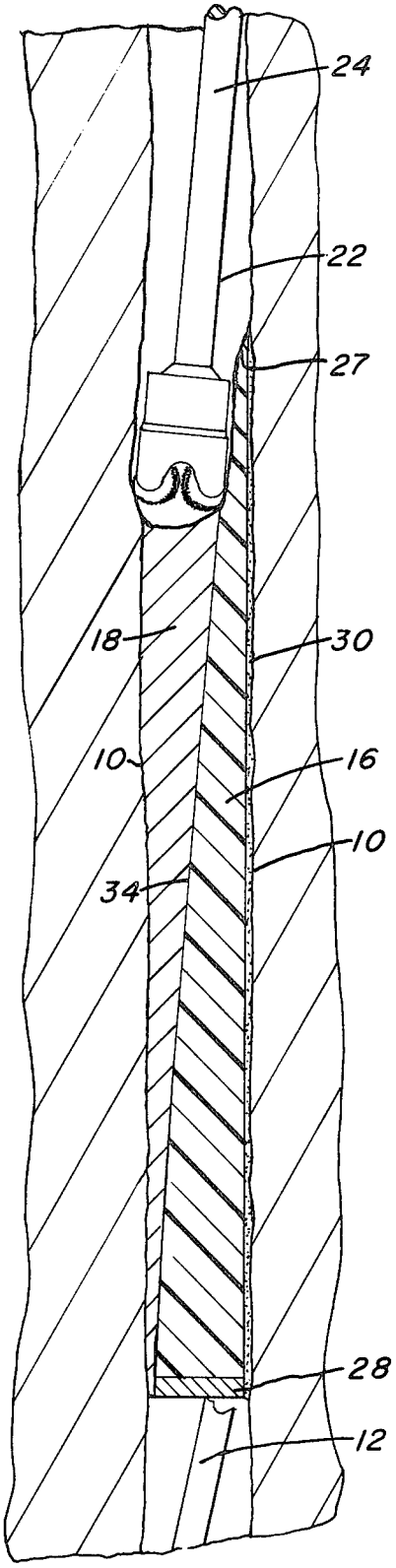
FIG. 3 is a side sectional view showing the whipstock compressed against and adhered to the side of the drill hole, the drill bit is shown starting a new offset drill hole as it moves across the face of the whipstock.
Figure 2:
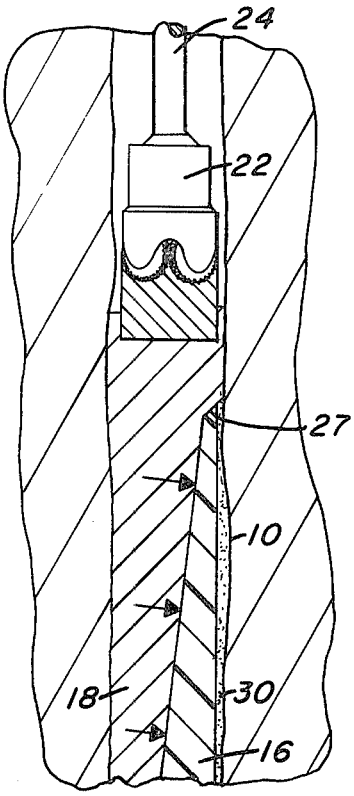
FIG. 2 is a side sectional view of another embodiment of the whipstock showing a flat compression face formed on the drill bit with the compression face forced downward on the filler material, deforming it to cause a lateral compression force against the whipstock to adhere it to the side of the drill hole.

Turning now more specifically to the drawings, FIG. 1 shows an existing, original drill hole or well 10 having equipment debris 12 or other obstruction remaining which would prevent further drilling and use of the hole. A directional drilling tool 14 according to the present invention is shown positioned within the hole and includes a wedge-shaped whipstock 16, deformable filler material 18, and compression member 20. These three components can all be formed as an integral, one-piece unit in an elongated cylindrical configuration as shown. This cylindrical, directional drilling tool 14 can be lowered into proper position in the original drill hole 10 by any arrangement desired. One method would be to use a J-hook (not shown) which can be attached between the tool 14 and the drill bit 22 connected to the end of the drill stem 24. Another arrangement described below is to attach or mold the compression member directly to threads of the drill stem or to the drill bit 22. The lowering could also be achieved with a wire line.

At the base or down hole end 26 of the tool 14 is located a reinforcing member 28 which can be in the form of a flat metal plate, cap, or other reinforcing arrangement. The reinforcing member 28 is provided so that the drill tool 14 can be rested directly upon the debris 12 to properly position the tool in the hole 10 during the setting process. It is also possible that instead of debris 12 remaining in the hole and providing the stop for positioning the tool, a bridge plug, open hole packer, or other mechanical device known in the industry can be positioned in the drill hole at the proper location for setting the whipstock. Of course, it is understood that the tool can also be set on the bottom of the hole.

As shown in FIG. 1, one arrangement for lowering the tool 14 into the hole 10 is to attach or mold the compression member 20 directly to a portion of the drill bit 22. Thus, it is possible to attach the entire directional tool 14 to the drill bit 22 and stem 24 for lowering the entire unit into proper position in the drill hole in one operation.

Figure 4:
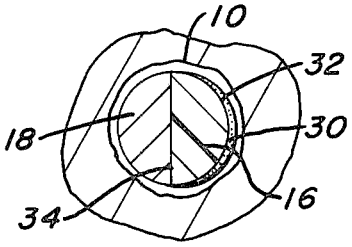
FIG. 4 is a cross-sectional view of the whipstock prior to deformation and taken along lines 4—4 of FIG. 1.

The overall dimension of the cylinder formed by the whipstock 16 and filler material 18 has a diameter which is usually in the range of 60 to 95 percent of the nominal diameter of the bare drill hole 10. As can be readily seen in FIG. 4, a relatively heavy or thick layer of suitable adhesive 30 is provided around the outside surface of the whipstock 16 of the tool 14. The adhesive layer 30 has a sufficient quantity of material so that it can be pressed to fill the voids that are found in the surface of the drill hole and sufficient strength to bond the outer surface of the whipstock to the drill hole even in the presence of water, sand, or drilling mud that would often be present. To provide additional friction and increase the bonding characteristic of the adhesive, it is possible to provide gravel or other filler aggregate in the adhesive to aid in filling the voids and also provide the necessary bonding characteristics for prevention of rotation during drill off.

Figures 5, 6, 7, 8, 9, 10, 11, 12, 13, 14:
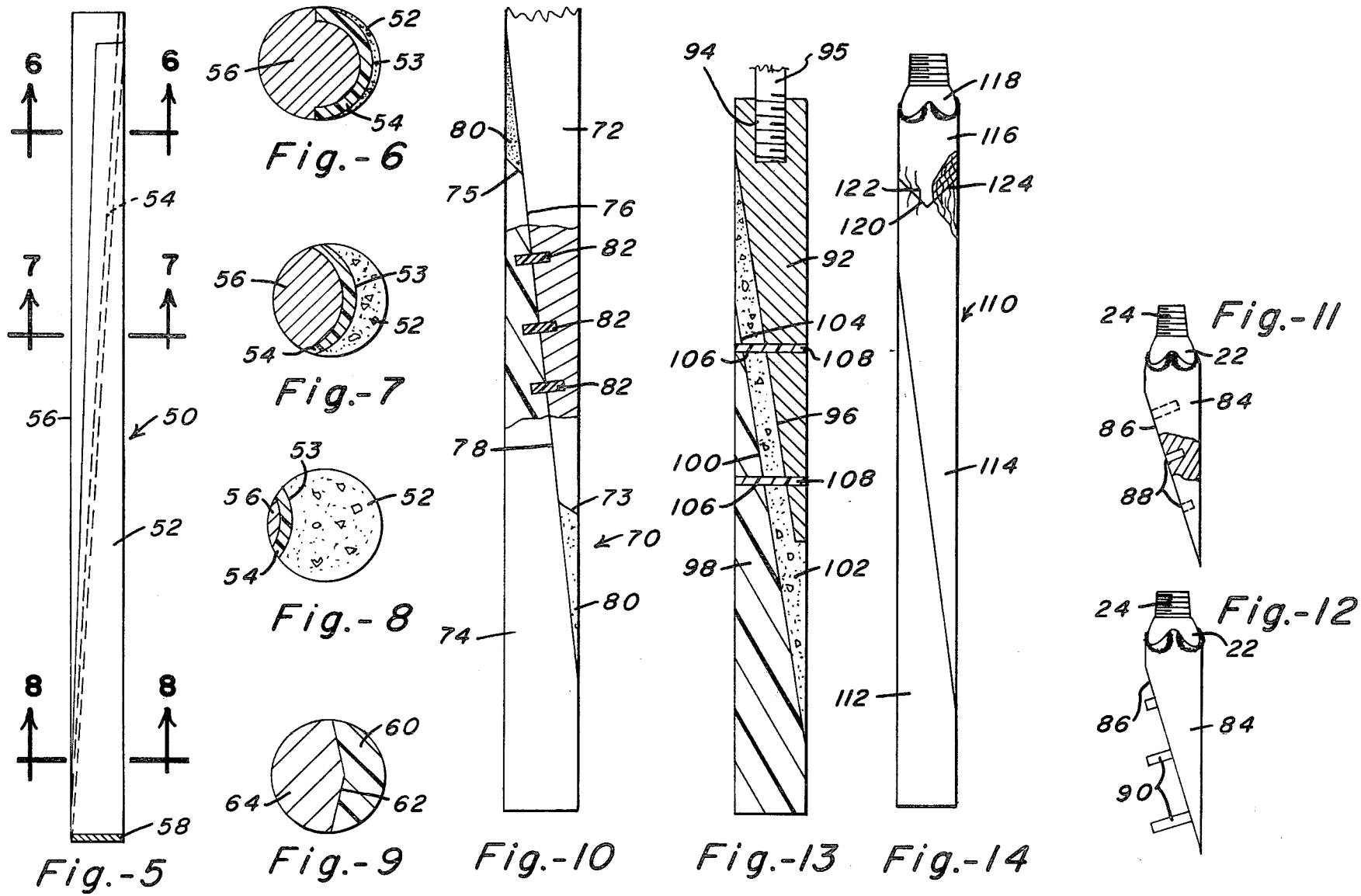
FIG. 5 is a side elevational view of the whipstock prior to insertion in the hole showing the cylindrical configuration and omitting the compression member.
FIG. 6 is a cross-sectional view taken along lines 6—6 of FIG. 5 showing a concave face at the lead end of the whipstock and the complementing filler material.
FIG. 7 is a cross-sectional view taken along lines 7—7 of FIG. 5 near the midpoint of the body showing the outer cylindrical configuration, a low-friction, tough, resilient coating or liner is provided on the face of the rigid material used as the body of the whipstock wedge.
FIG. 8 is a cross-sectional view taken along lines 8—8 of FIG. 5 at a location near the base of the whipstock also showing the low-friction material and the reduction of the thickness of the filler material in relation to the concave surface of the whipstock body.
FIG. 9 is a cross-sectional view of another embodiment of the whipstock according to the present invention with the whipstock formed from a solid polymeric material with the face in the shape of an open "V" and complemented by the shape of the deformable filler material.
FIG. 10 is a partial side elevation view of another embodiment of the whipstock showing a cutaway revealing the compression face shaped to complement the surface of the whipstock and joined by shear pins embedded in each element, deformable filler material is provided at the lead and trailing ends of the compression element to fill the voids between the whipstock and compression elements.
FIGS. 11 and 12 show a wedge-shaped compression element similar to the arrangement shown in FIG. 10 with the compression element molded and attached directly to the drill bit with holes or slots provided for the reception of shear pins or keys arranged to be received within the face of the whipstock for temporarily joining the compression element and the whipstock.
FIG. 13 is a side sectional view showing another embodiment of the whipstock with the compression element formed in a wedge shape but spaced from the face of the whipstock by the filler material and including transverse frangible elements for joining the components together prior to deformation.
FIG. 14 is another embodiment of the whipstock according to the present invention which includes a conically shaped compression face on the compression member which is secured directly to the drill bit, reinforcing fibers or elements are used to aid in bonding the compression member to the filler material.
Figure 15:
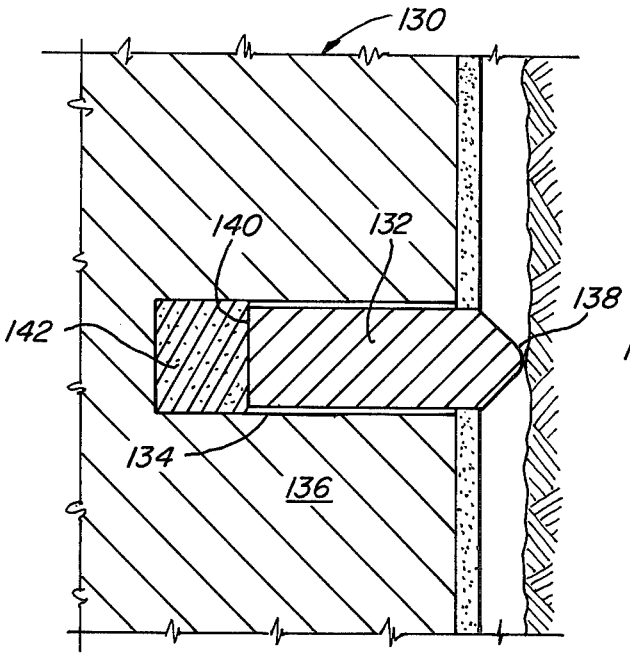
FIG. 15 is a cross-sectional view of a guide device shown in the extended position for centering the body of the whipstock in the hole during the lowering operation.
Figure 16:
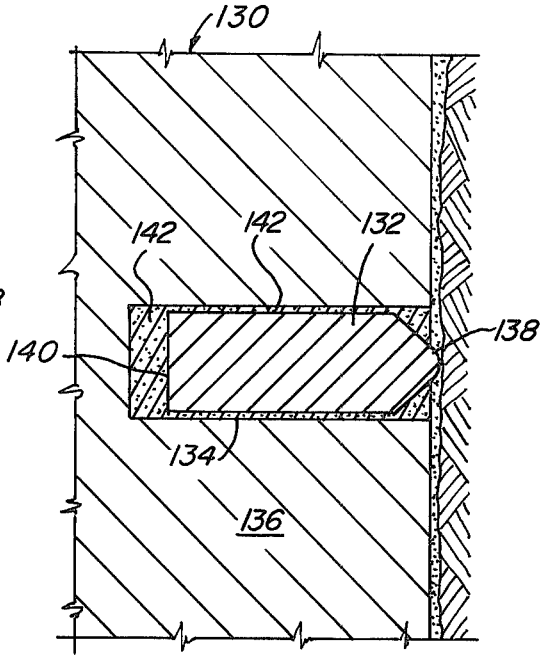
FIG. 16 is a cross-sectional view of the guide device shown in FIG. 15 with the guide compressed into the cavity during setting of the whipstock.

The wedge-shaped whipstock 16 has a thin lead or drill end 27 and a thick base end 26. The overall shape of the whipstock includes a taper or partial taper between the lead and base end. This angular taper can be modified as desired to provide the desired offset of the drill bit but usually is within the range of 1° to 10° from the longitudinal axis. It is possible to extend the base 26 so that there is a continuous cylindrical section below the intersection of the angled wedge surface with the outside surface of the cylinder to provide reinforcement and strength. The lead end of the wedge surface can be truncated with a slight bevel arrangement, as shown in FIG. 1, with the thickness of the lead edge sufficient to provide the desired strength for proper compression and adherence to the drill hole. The whipstock 16 has an outer face 32 which is covered with the adhesive 30 and an inner surface or face 34. The inner face 34 is provided for guidance and deflection of the rotary drill bit 22 as it progresses downwardly to form the new offset drill hole. The inner face 34 can have any desired surface configuration, such as the flat arrangement shown in FIG. 4, a concave arrangement as shown in FIGS. 6–8, V-shaped trough arrangement as shown in FIG. 9, or any other configuration which is desired for guiding and deflecting the rotary drill bit in its movement.

The compression member 20 typically has the same outer diameter as the combination of the whipstock 16 and filler material 18. The face 40 of the compression member can be of any configuration which will place the desired compression forces on the upper end of the filler material to cause it to deform in the desired fashion. The actual face 40 of the compression member 20 can be in a conical, hemispherical, ellipsoid, flat, or wedge shape, or any other configuration which is found to transmit the desired compressive forces.

The whipstock 16 is formed from a tough resilient polymeric material which has a relatively low coefficient of friction to permit the drill bit to pass easily down across the inner face. Examples of those materials which have been found suitable for this purpose are natural and synthetic rubbers, polyurethanes and polyamides such as nylon. Polymeric materials having an elastic modulus less than 5,000,000 psi and having an elastic elongation exceeding 2.5 percent have been found to be desirable.

As an alternative, the body of the wedge-shaped whipstock can be formed from a low cost rigid material such as wood, metal, concrete, or the like and coated or laminated with a tough polymeric liner along the inner surface 34 to provide the required toughness and low friction characteristics. On the outer surface 32 of the whipstock 16, the adhesive layer is coated liberally to adhere the wedge-shaped whipstock to the drill hole.

An example of an adhesive material which has been found to work satisfactorily is amorphous polypropylene which has been used and tested in various drilling experiments. This material is normally soft and tacky and by the addition of gravel, crushed rock, or any particulate abrasive, additional friction between the whipstock and drill hole can be obtained to resist movement after bonding.

The deformable filler material 18 can be made from any highly extensible, viscous material which is formed to complement the wedge-shaped whipstock and to complete the cylindrical configuration. Formulations for the filler material can contain various waxes, polymers, oils, clays and the like which provide the desired viscous characteristics. An example of a filler which has been found effective in use with the present invention is a compound formulated by weight as follows:

| | |
|---|---|
| Amorphous polypropylene | 100 parts |
| Cellulated glass granules, 12/20 mesh, 19 lb./ft.$^3$ density | 28 parts |
| Modeling clay, medium firmness | 185 parts |

This compound provides the desired compressive characteristics and the required deformation which will be explained later.

The frangible compression member 20 functions to compress the filler material by pressure applied to the face 40 of the member. The compressive face 40 and the entire member 20 has good compression strength but is fragile and easily broken by rotation of the drill at the desired time. Gypsum plaster has been found effective for this purpose when cast into a cylindrical section to form the compression member and can also be cast over the end of the rotary drill for bonding the drilling tool to the drill bit and stem. If desired, various reinforcing materials such as fiberglass, rope, string, wire or any other type of drillable reinforcing material can be mixed internally or arranged externally around the outside surface of the compression member to bond the drill bit to the compression member and also bond the compression member to the remaining portions of the directional tool. The casting of the compression member directly to the tool bit helps prevent the filler material from flowing upwardly into the drill bit and stem which might interfere or prevent proper flow of the drilling mud or air. In addition, the face of the compression member may preferably be formed in other shapes or have a diameter greater or smaller than the cylinder to insure that the top of the whipstock is forced against the wall of the drill hole and permanently bonded into position. It is to be understood that if desired the separate frangible compression member 20 can be omitted and the drill bit or stem can be substituted as the compression member to deform the filler material 18.

We have found a whipstock device constructed as shown in FIG. 10 to be advantageous with the frangible wedge being made of cast polyester resin. We have also found certain epoxy resins to provide the high compressive strength yet the frangibility required.

To better explain the operation and function of the improved directional drill tool and method as provided in the present invention, it is necessary at this point to understand the operation and function of the tool to provide the desired results.

When it is necessary to offset a new drill hole from the original hole for such reasons as the breakage of the existing drill stem or to redirect a drill hole into a better or required direction, the directional drill tool as provided in the present invention is mechanically or physcially connected to the drill bit provided at the end of the drill stem or to the drill stem itself. With either the broken drill rod 12 or a bridge plug located in the original drill hole, or off bottom, the tool 14 is lowered into the original drill hole until it is in contact and at rest on the obstruction. The whipstock face may be oriented in the desired geographic direction before lowering, or instrumentation known in the industry may be incorporated either internally or externally to the tool to allow the desired orientation after downhole placement. Thus, the direction of the deflecting face of the whipstock can be controlled by the rotational positioning of the drill stem.

Once the reinforcing plate 28 is placed in contact with the obstruction, downward longitudinal force is applied either to the filler material through the compression member or to the compression member itself by the constant weight of the drill stem resting upon the tool or a bumping effect or vibration is applied to the compression member to properly deform the filler material 18. Deformation of the filler material 18 along the wedge face 34 converts the downward longitudinal forces to radial or lateral forces which are applied against the inner surface or face 34 of the wedge 16. It is desirable that the filler material easily move downward along the face of the whipstock and outward towards the left as seen in FIG. 1 to fill the voids and space between the tool and the bare drill hole. Once the space between the wedge 16 and drill hole has been packed, the radial forces apply against the inner face of the wedge to laterally move the wedge with respect to the hole so that the outer surface 32 is placed in contact with the surface of the drill hole. The adhesive layer 30 is thus placed in contact with the surface of the hole. The adhesive layer 30 in this position is caused to deform and pressure bond the outer surface 32 of the whipstock permanently to the surface of the drill hole. It is intended that sufficient or excess adhesive material be present to substantially fill the usual voids or washouts that may be present in the surface of the hole and provide the required bond.

Although it would be desirable to deform the filler material the entire length of the tool and fill all corresponding voids in the hole surface, partial deformation in the upper half of the filler material may be sufficient to properly set the whipstock. Setting of the lower section will eventually occur during drill-off due to the bit weight.

Once the compression and deformation of the filler material has taken place and the whipstock has been bonded to the surface of the hole, rotation of the drill bit will break up and destroy the compression member with the broken pieces and filler material removed along with the flow of the drilling mud or air. Further rotation of the drill bit causes the bit to work downwardly and radially outward along the wedge-shaped whipstock which forces the drill bit into the side of the original drill hole with progressive removal of additional earth material. Once the drill bit has traversed the face of the whipstock, it continues in the deflected direction to form the desired new offset hole.

Another embodiment of the well directional drilling tool, as disclosed in the present invention, is the cylindrical tool shown in FIGS. 5 through 8. In this embodiment, the directional drilling tool 50 incorporates a wedge-shaped whipstock 52, fabricated from a low cost material that has substantial strength and rigidity. A reinforcing plate 58, as described hereinabove, is provided for supporting the whipstock in its proper position within the drill hole above the obstruction. The whipstock face or inner surface 53 is laminated with a relatively thick layer of polymeric material having a low coefficient of friction. This material may be nylon, polyurethane, or the like, which will allow the drill bit to pass freely across the surface of the whipstock and also permit the filler material 58 to slide and deform substantially the length of the whipstock 52. Any of the compression members described above can be used with directional drilling tool 50.

As shown in FIG. 9, the wedge-shaped whipstock 60 can have a trough or triangular shaped face 62 for guiding the passage of the drill bit. The filler material 64 and/or the compression member are formed to complement the face or inner surface 62 to complete the circular cross-section of the cylindrical tool.

Another embodiment of the present invention as shown in FIG. 10, is the provision of a directional drilling tool 70 having a wedge-shaped compression member 72. The angle of the face 76 of the compression member 72 is the same or nearly the same as the angle of the face 78 of the wedge-shaped whipstock 74. Thus, the inner face 76 of the compression member 72 also has a configuration which complements the inner face 78 of the whipstock 74. In this arrangement, there is actual surface-to-surface contact between the compression member 72 and whipstock 74 with filler material provided to fill the voids between the compression member and whipstock at the lead edge 75 and the base edge 73. The filler material 80 deforms to some degree and provides a radial compression force at the ends for setting the whipstock 74, but the main force for setting the whipstock is provided by the wedge face 76 of the compression member 72. It is also possible to omit the filler material 80 altogether and extend the compression member 72 the full length of the whipstock face 78. If desired, a coating or layer of low friction material may be provided between the face of the whipstock and compression member to permit movement between these elements during the setting process. It may be desirable to provide shear pins 82 located in apertures or recesses provided in both the compression member and whipstock to securely hold the elements together in their required relative position during the lowering process so that the whipstock is properly oriented. Thus, upon application of longitudinal force on the upper end of the compression member 72, the shear pins 82 separate allowing relative movement between the compression member 72 and the whipstock 74 for properly setting the whipstock in the hole. In this way, the operator of the drilling apparatus can be assured that he can apply a certain amount of force to the drill string as the directional tool is lowered into the hole without accidentally setting the whipstock in an incorrect location. Once the tool is positioned, only a relatively small additional force is required to break the shear pins and thereafter set the whipstock.

In the case where a whipstock tool constructed as in FIG. 10 is compressed, downward pressure or bumping would shear pins 82 move the frangible compressive element 72 downward to deform the filler material 80 and at the same time cause the tougher wedge 74 to move laterally until the double wedge assembly has moved to a position spanning the drill hole.

We have found that carbon shear pins having a shear strength of approximately 3700 pounds per square inch and certain plastic materials including copolymers of acrylonitrile-butadiene-styrene will provide the desired shear results. The shear pin arrangement described herein can be used with any of the embodiments that are included as part of the directional drilling tool of this invention.

As shown in FIGS. 11 and 12, the compression member 84 having a wedge face 86 can have recessed holes or slots 88 provided in the compression face 86. In the converse, the compression face 86 can include protuberances such as dowels or keys which would be matched to fit into receptacles provided in the face of the complementing whipstock. In the arrangement shown in FIG. 11, suitable shear pins or rectangular keys formed from breakable materials would be inserted in the receptacles 88 with the whipstock adapted to receive the opposite ends of these elements. In either case, the protuberances 90 or shear pins adapted for the apertures 88 provide the same function as the shear pins 82 described above.

In FIG. 13 is shown another variation of a wedge-shaped compression member 92 which has a threaded socket for insertion of a stub for connection to a coupling on the drill stem. The thread is "left-handed" so that the connection is loosened by the normal drilling rotation of the stem for safety purposes, so that the stub 95 can be removed from the whipstock after setting by the normal right hand drill string rotation. The face 96 of the compression member 92 is arranged to be spaced from and parallel to the face 100 of the whipstock 98. A suitable filler material 102, as previously described, is formed in the void between the two elements and is again allowed to deform and compress under longitudinal stress to properly set the whipstock. It can be noted that the leading edge 104 of the whipstock 98 is feathered to accept the compressive and radial forces generated by the compression element 92. Also, it is to be noted that the ends of the inner surface 96 of the compression member 92 are truncated to provide desired strength in the compression member and concentrate the longitudinal forces upon the filler material. Transverse aligned apertures are provided through the directional drilling tool and are sized to receive shear pins 108 for securely joining the elements together in their proper relation for the handling, lowering, or setting process. These shear pins 108 can be fabricated from any suitable material such as carbon or plastics which will provide suitable strength for handling and yet be capable of separating with the application of longitudinal force.

A directional drilling tool 110 as shown in FIG. 14 includes the wedge-shaped whipstock 112, complementing filler material 114, and the integrally formed and attached compression member 116 molded or bonded directly to the drill bit 118. The face 120 of the compression member 116 is shown in a pointed or conical configuration with external longitudinal fibers 122 or internally embedded elements or fibers 124 provided in the junction between the compressive member 116 and filler material 114. The elements or fibers 122, 124 provide longitudinal strength and reinforcment between the elements to assure a suitable bond for handling and lowering the directional drilling tool 110 into the well when required.

In order to center the whipstock tool 130 during the lowering operation, a guide device such as pin 132 can be inserted in radially positioned holes 134 formed in the wedge-shaped whipstock 136. Any number of pins can be positioned around the perimeter of the whipstock. Also to provide centering control, these pins are located usually below the filler material near the base of the whipstock. It is to be understood, however, that the guide pins could be positioned through the filler material and housed in the whipstock, if desired. Pins positioned through the face surface of the wedge would not have to be retractable as later described for the setting of the whipstock.

The pin 132 has a rounded outer end 138 and a generally flat rear portion 140. The pins can be made from any relatively rigid abrasion resistant material such as nylon, steel or the like and are retained and positioned in the hole by a deformable material 142 such as wax or modeling clay. The diameter of the hole 134 is larger than the diameter of pins 132 so that the deformable material 142 can be displaced alongside of the pin when the pin is compressed into the hole 134 during the setting of the whipstock 136.

In one embodiment of the guide pins the pins and mounting hole are approximately two inches long with the hole having a diameter of 0.77 inch and the pins $\frac{3}{4}$ inch. The 0.020 inch clearance was found to be sufficient to allow the deformable material to extend along the sides of the pin to allow the pins to retract. Through experimentation it was found that the use of wax as a deformable material allowed the pin to retract at a rate of 1 inch per minute with a force of 250 pounds applied to the outer end of the pin.

Figure 17:
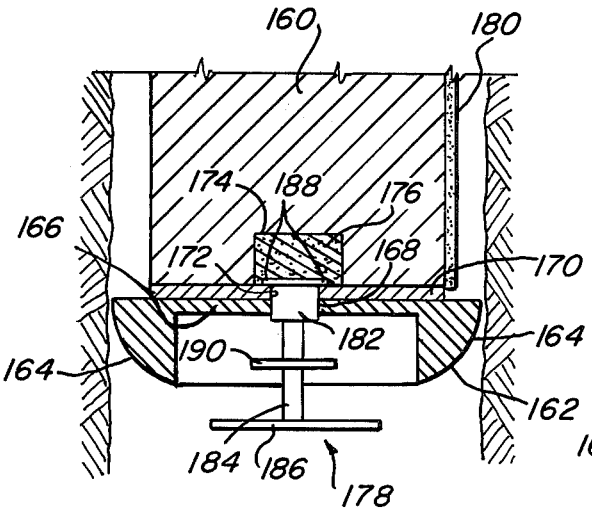
FIG. 17 is a cross-sectional view of another guide device or bumper positioned on the end of the whipstock.
Figure 18:
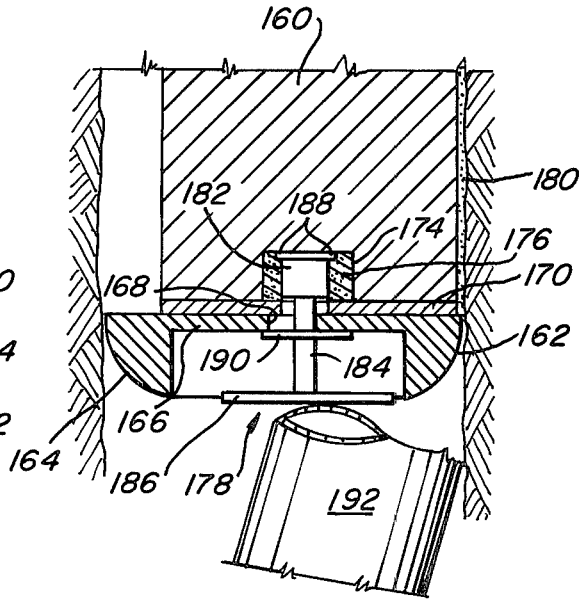
FIG. 18 is a cross-sectional view of the bumper of FIG. 17 with the retainer displaced to allow the bumper to move laterally to permit setting of the whipstock.

A guide bumper as shown in FIGS. 17 and 18 can be provided. If desired, this device can be used by itself or in combination with the pins described above. In this arrangement a circular bumper or guide ring 162 is centrally mounted on the end of the wedge-shaped whipstock 160. The guide ring 162 has outer rounded surface 164 and base plate 166. A large central positioning aperture 168 is provided in the base plate 166 for mounting the guide ring. A reinforcing plate 170, as discussed earlier, is provided at the end of the wedge-shaped whipstock 160. A control aperture 172 the same size as the base aperture 168 is provided in the reinforcing plate 170.

A cavity 174 having a relatively large volun . is positioned in the whipstock 160 in juxtaposition with the aperture 172. The interior of the cavity is filled or partially filled with a deformable material 176 such as wax or clay. A retaining plug 178 is positioned in the apertures 168 and 172 and holds the guide ring 162 in centered position on the end of the whipstock during the handling and lowering of the whipstock tool into the hole. A light adhesive or frangible fastening device (not shown) can be used to help hold the ring in centered position adjacent the reinforcing plate 170. The guide ring or bumper 162 centers the whipstock within the hole and permits it to move smoothly down the hole without jamming or scraping the adhesive 180 from the side of the whipstock 160.

The retaining plug 178 has a retaining head 182, shaft 184, and contact plate 186. The outside diameter of the retaining head 182 is sized to closely fit the apertures 168, 172. The end of the head 182 is positioned within the cavity 174 in contact with the deformable material 176. Shoulder or ears 188 extend outwardly behind the reinforcing plate 170 to hold the plug in retaining position. A bumper flange 190 is fixedly attached to the shaft 184 and spaced from the shoulder of the retaining head 182 a distance somewhat greater than the thickness of the base plate 166.

In use, when the whipstock 160 reaches the location where it is to be set, the plate 186 makes contact with the obstruction or plug 192 driving the retaining plug 178 longitudinally into the whipstock 160. The retaining head 182 moves slowly through the deformable material 176 until it stops at or near the end of the cavity 174. At this point the shoulder of the head 182 has cleared the aperture 168 in the base plate 166 and the aperture in the reinforcing plate 170 and light lateral force on the guide ring 162 causes it to slide sideways on the flange 190. Thus, the guide ring or bumper after its function has been completed is forced sidewise to allow the wedge-shaped whipstock 160 to be bonded and properly set to the side of the drill hole.

It is also possible to provide various modifications to the bumper arrangement. If it is desired to change the rate at which the retaining plug can move and thus, the release time for the plug, longitudinal holes can be provided in the retaining head to permit the deformable material 176 to more easily extrude. In addition, longitudinal grooves or slots can be provided along the outside surface of the head to also permit extrusion of the material. All of these reduce or control the release time for the guide ring and the start of the sequence for setting the whipstock. As an alternative to the deformable material in the cavity 176, this space can be left void and a shear pin may be fitted radially through the shaft 184 or retaining head 182. Upon placement, this shear pin breaks against the base plate 166 when the contact plate 186 contacts the obstruction 194 or the bottom of the hole.

It is to be understood that any of the described configurations can be utilized for the face of the compression member. This includes the basic convex shapes described, and also could encompass various concave shapes, if it is desired to concentrate the longitudinal compressive forces into the center or core area of the filler material. At times, it may be desirable to utilize various face configurations or combinations of configurations to accomplish different types of deformation patterns in the viscous filler depending upon the type of earthen material present at the desired location for the whipstock.

In addition it is to be understood that the whipstock tool described herein can also be used in conjunction with current or novel cementing techniques, if additional permanence in the hole is desired.

Throughout this specification, reference is made to the use of the present whipstock in a bare drill hole. This usage is intended for illustration purposes only and not for limitation. It is to be understood that the whipstock according to the present invention can be used in bare holes, well casing or any other drill hole condition. The operation of the whipstock according to the present invention is the same in any of these enviornments. The only major difference would be in the type of drill bit used in conjunction with the wedge-shaped whipstock deflector.

An improved, economical whipstock directional drilling tool and method has been shown and described in detail. It is obvious that this invention is not considered to be limited to the exact form disclosed and that changes in detail and construction may be made in the invention without departing from the spirit thereof.

Having set forth the nature of the invention, what is claimed is:

1. A whipstock tool for use in earth bores to deflect a drill bit and offset a new hole from the original drill hole, the tool comprising:

(a) a thin wedge-shaped body means having an outside surface generally conforming to the shape of the drill hole and an inside tapered surface along which a drill bit can move to guide and deflect the bit for drilling the new offset hole, the body means including a lead end having a generally thin cross-section and an opposite base end having a generally thick cross-section, the outside surface of said wedge-shaped body means having an adhesive means for adhering the body means to the surface of the drill hole;

(b) a filler means of deformable, viscous material arranged to complement the wedge-shaped body means and form an elongated cylinder with said body means, said cylinder having a diameter which is slightly less than the diameter of the drill hole; and (c) a compression means arranged near the lead end of the body means and in contact with said filler means whereby when said tool is positioned in the well hole and the compression means is moved longitudinally against said filler means, the filler means will be deformed along the inside tapered surface of the body means to fill the void between said body means and the surface of the drill hole so as to place a lateral force against the body means to press the outside surface of the body means and its adhesive means against the surface of the drill hole to permanently set the body means in said drill hole.

2. A whipstock tool as defined in claim 1 which further includes attaching means for lowering the tool into proper position in said drill hole so that said wedge-shaped body means can be permanently affixed in the desired location.

3. A whipstock tool as defined in claim 1 wherein said body means, filler means and compression means are formed together in a one-piece integral unit which can be easily transported and set into proper position in the drill hole.

4. A whipstock tool as defined in claim 1 wherein said wedge-shaped body means includes reinforcing means positioned at the base end and arranged so that said body means can be positioned against a rigid object within said drill hole to properly locate and support said whipstock tool.

5. A whipstock tool as defined in claim 1 which further includes a plug means which can be positioned in said drill hole to properly locate and support said wedge-shaped body means prior to setting.

6. A whipstock tool as defined in claim 1 wherein said adhesive means is a layer of adhesive on the outer surface of the wedge-shaped body means which layer includes particulate matter to increase the friction between said body means and the surface of said drill hole for increasing the gripping strength between said body means and said hole surface.

7. A whipstock tool as defined in claim 1 wherein the inside surface of said wedge-shaped body means is depressed inwardly to form a concave cross-section to guide the rotating drill bit to initiate the new offset drill hole.

8. A whipstock tool as defined in claim 1 wherein shear means is provided between said filler means and the inside surface of said wedge-shaped body means to more rigidly hold these components in relative position prior to the setting of the body means in the drill hole.

9. A whipstock tool as defined in claim 8 wherein said shear means includes one or more pins embedded in both the filler means and body means, said pins being formed from a material which can be easily fractured during setting of the body means.

10. A whipstock tool as defined in claim 9 wherein said pins are made from a frangible material.

11. A whipstock tool as defined in claim 1 wherein said wedge-shaped body is formed from a solid polymeric material.

12. A whipstock tool as defined in claim 11 wherein said solid polymeric material includes fillers or additives.

13. A whipstock tool as defined in claim 11 wherein said solid polymeric material has a low friction quality to aid in the passage of said drill bit.

14. A whipstock tool as defined in claim 1 wherein said wedge-shaped body is formed from a rigid material, and the face of the inside surface of said body means is laminated with a low friction, resilient material to aid in the passage of said drill bit.

15. A whipstock tool as defined in claim 1 wherein the filler means of said whipstock is formed from a material having a high viscosity which will deform at a slow rate upon the application of an external force.

16. A whipstock tool as defined in claim 15 wherein said filler means is made from a material compound including amorphous polypropylene, cellulated glass granules and clay.

17. A whipstock tool as defined in claim 1 wherein said filler means is positioned to extend beyond the lead end of said wedge-shaped body means so that compression forces will be concentrated upon the lead end of said wedge-shaped body means so that said body means will be sealed and permanently adhered to the surface of said drill hole.

18. A whipstock tool as defined in claim 1 wherein said compression means is bonded to the filler means and positioned so that a longitudinal force on said compression means will be transmitted to said filler means.

19. A whipstock tool as defined in claim 18 wherein the compression means is also bonded to a drill bit.

20. A tool for use in directional drilling as defined in claim 1 which further includes guide means provided on the wedge-shaped body to hold the body away from the surface of the drill hole during lowering and positioning, said guide means being retractable to allow the outside surface of the body to be forced into contact with the side of the drill hole so that it can be bonded to said surface.

21. A tool for use in directional drilling as defined in claim 20 wherein said guide means including a plurality of pins positioned in spaced relation around the circumference of said body, said pins being disposed in individual recesses in said body and having restraining means which hold the pins in extended position during positioning of the body but allows the pins to retract into the recesses when constant pressure is applied to the pin during bonding of the body to the surface of the hole.

22. A tool as described in claim 21 wherein the recess has a diameter slightly larger than the pin and is partially filled with a deformable material which will extrude around the sides of the pin allowing it to retract under force into said recess.

23. A tool as defined in claim 20 wherein said guide means includes a bumper means which is arranged to extend outwardly beyond the perimeter of said wedge-shaped body and at least partially around the circumstances of said body.

24. A tool as defined in claim 23 wherein said bumper means includes a plate having at least a portion of its outer perimeter rounded to move smoothly down the surface of the drill hole and releasable fastening means for holding the plate in centered position during positioning of the body and releasable upon being properly positioned so that the outside surface of the said body can be moved into contact with the surface of the drill hole for holding.

25. A tool as defined in claim 24 wherein said plate has a center aperture, and said releaseable means has a push rod having a piston at one end and a head at the opposite end, said piston having a diameter slightly less than the plate center aperture and positioned therein and arranged to extend partially into a recess in said body, said recess being filled with a deformable material which restrains movement of said piston, said head being arranged to extend downwardly beyond the end of the body so that when the head strikes an object, the weight of the body will force the deformable material to slowly move, allowing the piston to move into the recess so that the piston clears the center aperture of the plate, allowing the plate and piston to move sidewise to allow the body to move with respect to the drill hole.

26. A whipstock tool for use in well holes to deflect a drill bit and offset a new hole from the original hole, the tool comprising a non-metallic wedge-shaped body having a tapered face to guide and deflect a drill bit, the tapered face being formed from a tough, impact resistant, resilient material so that the crushing action of the drill bit will be absorbed while the drill bit is being guided and deflected.

27. A whipstock as defined in claim 26 wherein the tapered face is made from a polyamide material.

28. A whipstock as defined in claim 26 wherein said material has an elastic modulus less than 5,000,000 psi and having an elastic elongation exceeding 2.5 percent.

29. A whipstock tool as defined in claim 26 wherein the tapered face is made from polyurethane.

30. A method for drilling multiple side-track holes from an earth bore which includes the step of installing in said earth bore a separate resilient, non-metallic, wedge-shaped whipstock tool for deflecting a drill bit for drilling each sidetrack hole, said method further includes the step of removing the non-metallic, wedge-shaped whipstock tool after each sidetrack hole is completed and before starting the next by cutting out the wedge-shaped tool with a suitable cutting bit so that all sidetrack holes and the earth bore are open and interconnected.

31. A whipstock for deflecting the travel of drill bits in the drilling of earth bores, the whipstock comprising:
(a) means for deflecting said drill bit;
(b) means for adhering said deflecting means in proper location within the said drill hole;
(c) means for forcing the deflecting means into contact with the surface of said hole, whereby the deflecting means is forced laterally into contact with the surface of the drill hole and is permanently bonded to the surface by the adhering means; and
(d) means for attaching said whipstock to a device for lowering and positioning said whipstock in proper location in said drill hole.

32. A whipstock as defined in claim 31 wherein said forcing means is joined to said deflecting means by one or more shear pins embedded in both means and arranged to break upon application of force to said compressing means.

33. A whipstock as defined in claim 32 wherein said forcing means and said deflecting means are joined together by a tongue-and-groove means at least one groove of said tongue-and-groove means being arranged perpendicular to the longitudinal axis of said deflecting means.

34. A whipstock as defined in claim 31 wherein said forcing means is formed from a frangible material which can be broken and removed after the application of force to said deflecting means and the rotation of the drill bit.

35. A whipstock for deflecting the travel of drill bits in the drilling of earth bores, the whipstock comprising:
(a) means for deflecting said drill bit;
(b) means for adhering said deflecting means in proper location within said drill hole;
(c) means for forcing the deflecting means into contact with the surface of said hole, said forcing means includes a deformable means positioned along one side of said deflecting means and means for compressing the deformable means for generating a force to move said deflecting means laterally to bond it to the side of said drill hole by the adhering means.

36. A whipstock as defined in claim 35 wherein said compressing means is an element having a frangible face formed thereon, said frangible face being positioned in contact with said deformable means for compressing the deformable means and moving said deflecting means in a lateral direction.

37. A whipstock as defined in claim 36 wherein said frangible face is generally flat and perpendicular to the longitudinal axis of said deflecting means.

38. A whipstock as defined in claim 36 wherein said frangible face has a conical configuration.

39. A whipstock as defined in claim 36 wherein said frangible face has a hemispherical configuration.

40. A whipstock as defined in claim 36 wherein said frangible face is formed in a wedge-shaped configuration with the face of the wedge arranged generally parallel to and complementing the face of the deflecting means.

41. A whipstock as defined in claim 33 wherein said compression means is attached to said drill bit.

42. A whipstock as defined in claim 33 wherein said deflecting means, compressing means, and deformable means are formed as a one-piece integral unit having an elongated cylindrical configuration.

43. A whipstock as defined in claim 33 wherein said deformable means and deflecting means are formed as an integral unit.

44. A method for changing the direction of an earth drill hole to form a new offset drill hole, the method comprising:
(a) coating the outside surface of a wedge-shaped drill bit deflector with a suitable adhesive material;
(b) placing the wedge-shaped deflector in proper position in said drill hole;
(c) deforming a material along an angled face of the wedge-shaped deflector so as to laterally compress the outside surface of the deflector against the surface of said drill hole;
(d) bonding the deflector to the surface of the drill hole with the adhesive material; and
(e) drilling out the deformed material by moving a rotating drill bit downward along the face of the secured deflector and initiating a new drill hole in an offset direction from the original drill hole.

45. A method for changing drill hole direction as described in claim 44 wherein the deforming step is accomplished by using a longitudinal compressing force to move the deformable material along the face of the deflector to create lateral forces for adhering the deflector to the surface of the drill hole.

46. A method for changing drill hole direction as described in claim 44 which further includes the step of lowering the deflector into proper place by use of the drill stem.

47. A method for changing drill hole direction as described in claim 44 which includes the step of coating the wedge face of the deflector with a tough, low friction polymeric material prior to placing the deflector in position within the drill hole.

48. A method for changing drill hole direction as described in claim 44 wherein frangible pins are positioned in both said deflector and the deformable material prior to the placement of the deflector in the drill hole so that only upon application of a longitudinal force will the pins be fractured allowing the deformable material to easily deform along the wedge face of said deflector.

49. A method for changing drill hole direction as described in claim 44 wherein a complementing angled face is formed on the deformable material which is positioned in contact with the angled face of the deflector so that as said material is deformed an even compression force will be applied against the angled face of the deflector to aid the adhering of the deflector to the wall of the drill hole.

50. A method for changing the direction of an earth drill hole to form a new offset drill hole, the method comprising:
(a) placing the wedge-shaped deflector in proper position in said drill hole;
(b) applying longitudinal force to the angled surface of the wedge-shaped deflector to laterally compress the outside surface of the deflector against the surface of said drill hole;
(c) bonding the deflector to the surface of the drill hole with an adhesive material; and
(d) passing a rotating drill bit downward along the angled surface of the secured deflector to initiate a new drill hole in an offset direction from the original drill hole.

51. A whipstock tool for use in well holes to deflect the drill bit and offset a new hole from the original hole, the tool comprising a rigid wedge-shaped body, the angular face of which is laminated with a tough, impact resistant, resilient material having an elastic modulus less than 5,000,000 PSI and having an elastic elongation exceeding 2.5 percent.

52. A whipstock tool for use in well holes to deflect a drill bit and offset a new hole from the original hole, the tool comprising a non-metallic wedge-shaped body having a tapered face to guide and deflect a drill bit, said wedge-shaped body having a rigid material core with a tough, impact resistent, resilient material being formed as a layer on the tapered face of said wedge-shaped body.

* * * * *

UNITED STATES PATENT OFFICE
CERTIFICATE OF CORRECTION

Patent No. 4,182,423 Dated January 8, 1980

Inventor(s) TIMOTHY D. ZIEBARTH, ET AL.

It is certified that error appears in the above-identified patent and that said Letters Patent are hereby corrected as shown below:

Claim 23, lines 4 and 5, change "circumstances" to "circumference".

Claim 24, line 9, change "holding" to "bonding".

Signed and Sealed this

*Twenty-fifth* Day of *March 1980*

[SEAL]

*Attest:*

SIDNEY A. DIAMOND

*Attesting Officer* *Commissioner of Patents and Trademarks*